US007500278B2

(12) United States Patent
Leach

(10) Patent No.: US 7,500,278 B2
(45) Date of Patent: Mar. 10, 2009

(54) INFANT PAD ASSEMBLY WITH MULTIPLE CONFIGURATIONS

(76) Inventor: Jamie S. Leach, 130 E. Tenth St., Ada, OK (US) 74820

( * ) Notice: Subject to any disclaimer, the term of this patent is extended or adjusted under 35 U.S.C. 154(b) by 147 days.

(21) Appl. No.: 11/446,459

(22) Filed: Jun. 5, 2006

(65) Prior Publication Data

US 2007/0277321 A1 Dec. 6, 2007

(51) Int. Cl.
*B68G 5/00* (2006.01)

(52) U.S. Cl. ..... 5/655; 5/652; 5/424

(58) Field of Classification Search ..... 5/652, 5/655, 424–427, 99.1
See application file for complete search history.

(56) References Cited

U.S. PATENT DOCUMENTS

| | | | |
|---|---|---|---|
| 395,043 | A | 12/1888 | Doremus |
| 416,970 | A | 12/1889 | Taylor |
| 726,164 | A | 4/1903 | Hogan et al. |
| 909,453 | A | 1/1909 | Pullman |
| 1,376,625 | A | 5/1921 | Johnston |
| 1,447,288 | A | 3/1923 | Emmerich |
| 1,577,586 | A | 3/1926 | Morehouse |
| 1,769,722 | A | 7/1930 | Sutton |
| 2,149,140 | A | 2/1939 | Gonzalez-Rincones |
| D124,296 | S | 12/1940 | Thompson |
| 2,279,867 | A | 4/1942 | Falk |
| 2,328,871 | A | 9/1943 | Woehler |
| 2,336,707 | A | 12/1943 | Thompson |
| 2,404,108 | A | 7/1946 | Stauffacher et al. |
| 2,404,505 | A | 7/1946 | Knecht |
| 2,429,350 | A | 10/1947 | Farrand |
| 2,451,007 | A | 10/1948 | White |
| 2,495,482 | A | 1/1950 | Rogatz |
| 2,502,486 | A | 4/1950 | Savrin |
| 2,544,896 | A | 3/1951 | Nidetch et al. |
| D162,858 | S | 4/1951 | McGlinchey |
| 2,626,407 | A | 1/1953 | Kurry |
| 2,652,183 | A | 9/1953 | Hlivka |
| 2,694,202 | A | 11/1954 | Macrides |
| 2,694,204 | A | 11/1954 | Cross |
| 2,741,412 | A | 4/1956 | Hinkle |
| 2,795,802 | A | 6/1957 | Myers |

(Continued)

FOREIGN PATENT DOCUMENTS

| | | |
|---|---|---|
| JP | 20041949989 | 7/2004 |

(Continued)

OTHER PUBLICATIONS

Leachco, Inc., Nap 'N Pack Information Sheet, 1993 (Leachco, Inc., Ada, OK USA).

(Continued)

*Primary Examiner*—Fredrick Conley
(74) *Attorney, Agent, or Firm*—Mary M. Lee

(57) ABSTRACT

A convertible baby or infant bed in combination with a play mat and diaper changing station assembly comprising a rectangular central padded section contiguous with hinged members along each side of the rectangular central section, the hinged members pivoting upward to adjoin other proximal hinged members by means of a hook and loop fastener or other means of attachment, the assembly being adapted to fold into tote form and provided with a shoulder strap for ease of carrying.

10 Claims, 4 Drawing Sheets

U.S. PATENT DOCUMENTS

| | | | | |
|---|---|---|---|---|
| 2,817,090 | A | | 12/1957 | Toellner |
| 2,857,957 | A | | 10/1958 | Gay |
| 2,880,424 | A | | 4/1959 | Kalensky |
| D191,513 | S | | 10/1961 | Kerr |
| 3,088,438 | A | | 5/1963 | Oliphant |
| D201,492 | S | | 6/1965 | Jacobson |
| 3,239,271 | A | | 3/1966 | Bergersen |
| 3,298,035 | A | | 1/1967 | Gobins |
| 3,327,330 | A | | 6/1967 | McCullough |
| 3,392,737 | A | | 7/1968 | Fefferman |
| 3,604,026 | A | | 9/1971 | Scheips |
| 3,604,750 | A | | 9/1971 | Doering |
| 3,671,977 | A | | 6/1972 | Degnon |
| 3,713,692 | A | | 1/1973 | McCracken et al. |
| D227,423 | S | | 6/1973 | Ando |
| 3,773,287 | A | | 11/1973 | Hechinger |
| D230,804 | S | | 3/1974 | Lijewski |
| 3,840,916 | A | | 10/1974 | Jennings |
| 3,848,281 | A | | 11/1974 | Matthews |
| 3,899,210 | A | | 8/1975 | Samhammer et al. |
| 3,899,797 | A | | 8/1975 | Gunst |
| 3,911,512 | A | | 10/1975 | Plate |
| D244,569 | S | | 6/1977 | Laroye |
| 4,027,888 | A | | 6/1977 | Wilcox |
| 4,031,567 | A | | 6/1977 | Planck |
| 4,037,764 | A | | 7/1977 | Almosnino et al. |
| 4,050,737 | A | | 9/1977 | Jordan |
| 4,173,048 | A | | 11/1979 | Varaney |
| 4,179,158 | A | | 12/1979 | Flaum et al. |
| 4,194,254 | A | | 3/1980 | Torrez |
| 4,197,604 | A | | 4/1980 | Nakamura |
| 4,227,270 | A | | 10/1980 | Rivera |
| 4,235,474 | A | | 11/1980 | Rosenberg |
| 4,236,264 | A | | 12/1980 | Britzman |
| D259,902 | S | | 7/1981 | Rock |
| 4,287,542 | A | | 9/1981 | Okuda |
| D265,027 | S | | 6/1982 | Meyers |
| D266,800 | S | | 11/1982 | Kula et al. |
| 4,383,713 | A | | 5/1983 | Roston |
| 4,393,530 | A | | 7/1983 | Stark |
| 4,428,514 | A | | 1/1984 | Elf |
| 4,434,920 | A | | 3/1984 | Moore |
| 4,463,984 | A | | 8/1984 | Molnar |
| 4,506,396 | A | | 3/1985 | Ritchie, Jr. et al. |
| 4,550,459 | A | | 11/1985 | Endel et al. |
| 4,574,412 | A | | 3/1986 | Smith |
| D284,220 | S | | 6/1986 | Pote |
| 4,592,589 | A | | 6/1986 | Hellwig |
| 4,606,078 | A | | 8/1986 | Tkacsik |
| 4,606,087 | A | | 8/1986 | Alivizatos |
| 4,624,021 | A | | 11/1986 | Hofstetter |
| 4,654,907 | A | | 4/1987 | Haugaard |
| 4,666,017 | A | | 5/1987 | Zimmerman |
| 4,667,356 | A | | 5/1987 | Holmquist |
| 4,667,624 | A | | 5/1987 | Smith |
| 4,670,923 | A | | 6/1987 | Gabriel et al. |
| 4,676,198 | A | | 6/1987 | Murray |
| 4,676,554 | A | | 6/1987 | Harlick et al. |
| 4,685,163 | A | | 8/1987 | Quillen et al. |
| 4,698,862 | A | | 10/1987 | Mairs |
| 4,709,430 | A | | 12/1987 | Nicoll |
| 4,712,258 | A | | 12/1987 | Eves |
| 4,731,890 | A | | 3/1988 | Roberts |
| 4,754,509 | A | | 7/1988 | Pollard |
| 4,754,510 | A | | 7/1988 | King |
| 4,757,925 | A | | 7/1988 | Knittel |
| 4,763,369 | A | | 8/1988 | Spector |
| 4,788,726 | A | | 12/1988 | Rafalko |
| 4,790,035 | A | | 12/1988 | Whyte |
| 4,794,657 | A | | 1/1989 | Avery |
| 4,796,315 | A | | 1/1989 | Crew |
| D299,988 | S | | 2/1989 | Parabita |
| 4,827,542 | A | | 5/1989 | Kurtenback |
| 4,834,459 | A | | 5/1989 | Leach |
| 4,836,605 | A | | 6/1989 | Greenwood et al. |
| 4,840,144 | A | | 6/1989 | Voorhees et al. |
| 4,850,144 | A | | 7/1989 | Grisham et al. |
| 4,853,994 | A | | 8/1989 | Ekstein |
| 4,861,109 | A | | 8/1989 | Leach |
| D303,897 | S | | 10/1989 | Phillips |
| 4,871,210 | A | | 10/1989 | Alexander et al. |
| 4,901,384 | A | | 2/1990 | Eary |
| D306,948 | S | | 4/1990 | Zollinger |
| D308,788 | S | | 6/1990 | Boehm |
| D309,018 | S | | 7/1990 | Leach |
| D310,609 | S | | 9/1990 | Burkhardt |
| D313,141 | S | | 12/1990 | Witter et al. |
| 4,980,937 | A | | 1/1991 | Mason et al. |
| 4,986,458 | A | | 1/1991 | Linday |
| 4,996,734 | A | | 3/1991 | Rowe |
| 4,999,863 | A | * | 3/1991 | Kane ..... 5/98.1 |
| 4,999,866 | A | | 3/1991 | Lindsey |
| 5,015,037 | A | | 5/1991 | Giblin et al. |
| 5,026,315 | A | | 6/1991 | Chap |
| D318,202 | S | | 7/1991 | Weber |
| 5,035,013 | A | | 7/1991 | Bloom |
| D318,969 | S | | 8/1991 | Byrn |
| 5,048,136 | A | | 9/1991 | Popitz |
| 5,088,141 | A | | 2/1992 | Meyer et al. |
| 5,097,551 | A | | 3/1992 | Smith |
| 5,103,514 | A | | 4/1992 | Leach |
| 5,109,557 | A | | 5/1992 | Koy et al. |
| 5,115,524 | A | | 5/1992 | Antosko |
| 5,119,767 | A | | 6/1992 | Jimenez |
| 5,154,649 | A | | 10/1992 | Pender |
| 5,159,727 | A | | 11/1992 | McCracken |
| 5,161,260 | A | | 11/1992 | Reynolds |
| 5,165,130 | A | | 11/1992 | Wendling |
| 5,178,309 | A | | 1/1993 | Bicheler et al. |
| 5,179,741 | A | | 1/1993 | Book |
| D332,865 | S | | 2/1993 | Wilmink |
| 5,187,309 | A | | 2/1993 | Esch et al. |
| 5,193,238 | A | | 3/1993 | Clute |
| 5,216,772 | A | | 6/1993 | Clute |
| D339,923 | S | | 10/1993 | Clarke |
| 5,249,308 | A | | 10/1993 | Blume |
| 5,261,134 | A | | 11/1993 | Matthews |
| D342,615 | S | | 12/1993 | Asher |
| 5,269,323 | A | | 12/1993 | Krouskop |
| 5,272,780 | A | | 12/1993 | Clute |
| 5,310,245 | A | | 5/1994 | Lyszczasz |
| 5,325,818 | A | | 7/1994 | Leach |
| 5,339,472 | A | | 8/1994 | Yin |
| 5,341,531 | A | | 8/1994 | Straub et al. |
| 5,346,278 | A | | 9/1994 | Dehondt |
| 5,363,524 | A | | 11/1994 | Lang |
| 5,365,613 | A | | 11/1994 | Henegan |
| 5,371,909 | A | | 12/1994 | McCarty |
| D355,306 | S | | 2/1995 | Moses |
| 5,429,852 | A | | 7/1995 | Quinn |
| 5,439,008 | A | | 8/1995 | Bowman |
| D365,241 | S | | 12/1995 | Braden et al. |
| 5,473,785 | A | * | 12/1995 | Lager et al. ..... 5/655 |
| D366,368 | S | | 1/1996 | McCarthy |
| 5,490,528 | A | | 2/1996 | Day |
| D369,054 | S | | 4/1996 | Straub et al. |
| D369,934 | S | | 5/1996 | Straub et al. |
| 5,519,906 | A | | 5/1996 | Fanto-Chan |
| D370,585 | S | | 6/1996 | Faithfull |
| 5,522,528 | A | | 6/1996 | Petricola |
| 5,546,620 | A | | 8/1996 | Matthews |
| 5,551,109 | A | | 9/1996 | Tingley et al. |
| D375,557 | S | | 11/1996 | Dixon |
| 5,570,823 | A | | 11/1996 | Lindy |

| | | | | |
|---|---|---|---|---|
| 5,572,753 | A | | 11/1996 | Ruscitto |
| 5,581,833 | A | | 12/1996 | Zenoff |
| 5,586,351 | A | | 12/1996 | Ive |
| D377,423 | S | | 1/1997 | Latrella et al. |
| D377,881 | S | | 2/1997 | Watt |
| 5,621,919 | A | | 4/1997 | Graham |
| 5,647,076 | A | | 7/1997 | Gearhart |
| D381,790 | S | | 8/1997 | Harris et al. |
| D382,435 | S | | 8/1997 | Schaffner et al. |
| 5,661,861 | A | | 9/1997 | Matthews |
| 5,664,271 | A | | 9/1997 | Bellavance |
| 5,685,016 | A | | 11/1997 | Douglas |
| 5,699,569 | A | | 12/1997 | Schwarz-Zohrer |
| D388,589 | S | | 1/1998 | Walker |
| 5,708,982 | A | | 1/1998 | Armani |
| 5,778,470 | A | | 7/1998 | Haider |
| 5,813,066 | A | | 9/1998 | Gebhard et al. |
| 5,822,817 | A | * | 10/1998 | Carew et al. ..... 5/732 |
| 5,826,287 | A | | 10/1998 | Tandrup |
| 5,839,138 | A | | 11/1998 | Weidman et al. |
| 5,857,598 | A | | 1/1999 | Dunne |
| D408,676 | S | | 4/1999 | Straub et al. |
| D409,038 | S | | 5/1999 | Rojas, Jr. et al. |
| D412,234 | S | | 7/1999 | Cox |
| 5,930,854 | A | | 8/1999 | O'Neill et al. |
| D413,751 | S | | 9/1999 | Alyea |
| 5,946,725 | A | | 9/1999 | Shatzkin et al. |
| 5,950,887 | A | | 9/1999 | Powell |
| D414,915 | S | | 10/1999 | Anderson |
| D416,745 | S | | 11/1999 | Noyes |
| 5,978,990 | A | | 11/1999 | Akey |
| 5,979,981 | A | | 11/1999 | Dunne et al. |
| 5,987,674 | A | | 11/1999 | Schaffner et al. |
| D419,819 | S | | 2/2000 | Bartoli |
| D420,845 | S | | 2/2000 | Rumage |
| 6,026,525 | A | | 2/2000 | Davis |
| 6,038,720 | A | | 3/2000 | Matthews et al. |
| 6,045,178 | A | | 4/2000 | Miller |
| 6,049,929 | A | | 4/2000 | Rawson |
| 6,052,848 | A | | 4/2000 | Kelly |
| 6,055,687 | A | | 5/2000 | Matthews |
| 6,061,854 | A | | 5/2000 | Crowley |
| 6,065,655 | A | | 5/2000 | Parewick |
| 6,079,067 | A | | 6/2000 | Becker et al. |
| 6,088,854 | A | | 7/2000 | Brownrigg |
| 6,112,960 | A | | 9/2000 | Seering et al. |
| 6,119,873 | A | | 9/2000 | Matthews |
| 6,123,389 | A | | 9/2000 | O'Connor et al. |
| D431,745 | S | | 10/2000 | Jackson |
| 6,141,805 | A | | 11/2000 | Fisher-Cohen et al. |
| 6,141,807 | A | | 11/2000 | Tapper |
| 6,205,600 | B1 | | 3/2001 | Sedlack |
| 6,209,962 | B1 | | 4/2001 | Sobel et al. |
| 6,212,717 | B1 | | 4/2001 | Cooper |
| 6,213,362 | B1 | | 4/2001 | Lorenzini et al. |
| D443,461 | S | | 6/2001 | Hall et al. |
| D444,981 | S | | 7/2001 | Hall et al. |
| D445,506 | S | | 7/2001 | Vinson et al. |
| D446,675 | S | | 8/2001 | Straub |
| 6,279,185 | B1 | | 8/2001 | Matthews |
| D447,376 | S | | 9/2001 | Kramer |
| D450,517 | S | | 11/2001 | Darling et al. |
| D453,653 | S | | 2/2002 | Tunnell |
| 6,343,727 | B1 | | 2/2002 | Leach |
| 6,349,437 | B1 | | 2/2002 | Horning |
| 6,354,665 | B1 | | 3/2002 | Ross |
| 6,408,463 | B1 | | 6/2002 | Palacio |
| 6,412,128 | B1 | | 7/2002 | Matthews |
| 6,427,251 | B1 | | 8/2002 | Leach |
| 6,434,769 | B1 | | 8/2002 | Koenig |
| 6,434,770 | B2 | | 8/2002 | Matthews Brown |
| 6,453,493 | B1 | | 9/2002 | Matthews Brown |
| 6,457,195 | B1 | | 10/2002 | Holste |
| 6,463,608 | B1 | | 10/2002 | Moe |
| 6,484,337 | B1 | | 11/2002 | Moe et al. |
| D467,117 | S | | 12/2002 | Guy |
| 6,499,164 | B1 | | 12/2002 | Leach |
| 6,499,165 | B1 | | 12/2002 | Morgillo |
| 6,505,366 | B1 | | 1/2003 | Lied |
| 6,532,612 | B2 | | 3/2003 | Matthews Brown |
| 6,539,567 | B1 | | 4/2003 | Bae |
| 6,553,590 | B1 | | 4/2003 | Leach |
| 6,574,810 | B2 | | 6/2003 | Mangiaracina |
| 6,601,252 | B1 | | 8/2003 | Leach |
| 6,625,828 | B2 | | 9/2003 | Matthews Brown |
| 6,640,977 | B2 | | 11/2003 | Matthews Brown et al. |
| 6,658,681 | B2 | | 12/2003 | Britto et al. |
| 6,662,390 | B1 | | 12/2003 | Berger |
| 6,671,907 | B1 | | 1/2004 | Zuberi |
| 6,671,908 | B2 | | 1/2004 | Brown et al. |
| 6,685,024 | B1 | | 2/2004 | Matthews |
| 6,692,072 | B2 | | 2/2004 | Nelson et al. |
| 6,708,354 | B1 | | 3/2004 | Carter et al. |
| 6,711,770 | B1 | | 3/2004 | Owens et al. |
| 6,751,817 | B1 | | 6/2004 | Leach |
| D492,533 | S | | 7/2004 | Cole |
| 6,760,934 | B1 | | 7/2004 | Leach |
| 6,763,539 | B1 | | 7/2004 | Bartley et al. |
| D493,964 | S | | 8/2004 | Low |
| 6,802,092 | B1 | | 10/2004 | Klein |
| 6,814,405 | B2 | | 11/2004 | Norman |
| 6,851,143 | B2 | | 2/2005 | Matthews Brown |
| 6,857,150 | B2 | | 2/2005 | Matthews Brown et al. |
| D503,063 | S | | 3/2005 | Bartle et al. |
| 6,874,183 | B1 | | 4/2005 | Taylor |
| 6,892,406 | B2 | | 5/2005 | Littlehorn |
| 6,905,169 | B1 | | 6/2005 | Donoghue |
| 6,920,655 | B2 | | 7/2005 | Mitchell |
| 6,944,898 | B2 | | 9/2005 | Matthews Brown et al. |
| 7,000,273 | B2 | | 2/2006 | Rivera-Wienhold et al. |
| 7,000,274 | B2 | | 2/2006 | Matthews Brown et al. |
| 7,000,275 | B2 | | 2/2006 | Matthews Brown et al. |
| 7,000,766 | B2 | | 2/2006 | Matthews Brown et al. |
| 7,010,821 | B1 | | 3/2006 | Leach |
| 7,017,212 | B2 | | 3/2006 | Matthews Brown |
| D518,989 | S | | 4/2006 | Clapp |
| 7,055,196 | B2 | | 6/2006 | Littlehorn |
| 7,089,639 | B2 | | 8/2006 | Matthews Brown et al. |
| 7,114,206 | B2 | | 10/2006 | Leach |
| 7,127,760 | B2 | | 10/2006 | Bartley et al. |
| 7,131,156 | B1 | | 11/2006 | Walker-Craft |
| 7,146,663 | B2 | | 12/2006 | Brown et al. |
| 2002/0029422 | A1 | | 3/2002 | Matthews |
| 2004/0060116 | A1 | | 4/2004 | Matthews-Brown |
| 2005/0210591 | A1 | | 9/2005 | Mead et al. |
| 2006/0031992 | A1 | | 2/2006 | Moore |
| 2007/0022526 | A1 | | 2/2007 | Leach |
| 2007/0028384 | A1 | | 2/2007 | Leach |
| 2007/0046084 | A1 | | 3/2007 | Leach |
| 2007/0151031 | A1 | | 7/2007 | Leach |

FOREIGN PATENT DOCUMENTS

WO PCT/US01/27068 A1 8/2001

OTHER PUBLICATIONS

Triple Play Products, LLC, The Nap-Sac by Lilly Gold, a web page found at http://www.tripleplayproducts.com/napsac.asp, 2004 (Triple Play Products, LLC, Hopkins, MN USA).

Baby Shop Magazine, Juvenile Products webpage at http://www.babyshopmagazine.com/ebs/july03/ebs_theedge-jp.htm, Issue #9, Jul. 2003 (Baby Shop Magazine Pittsburgh, PA USA).

Abstract, JP 2004 194989, Jul. 15, 2004, ESPACENET.

* cited by examiner

Fig. 1
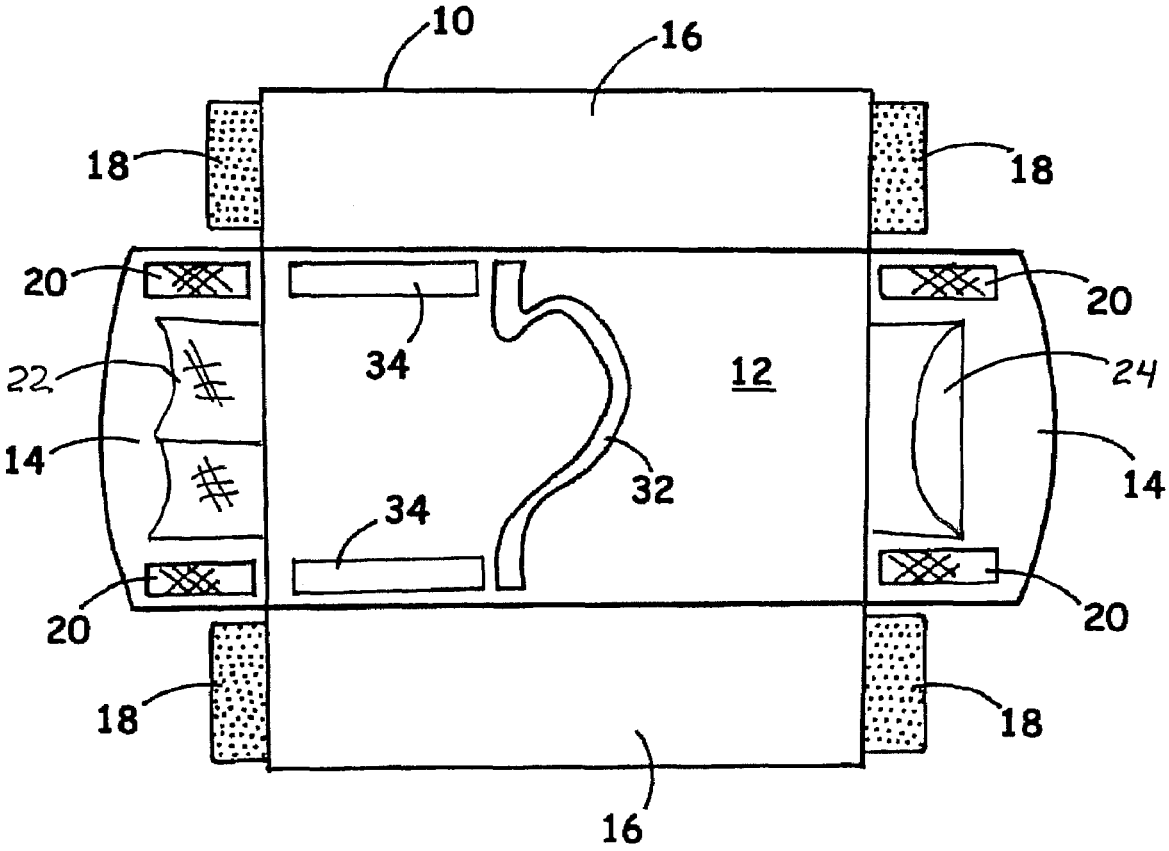
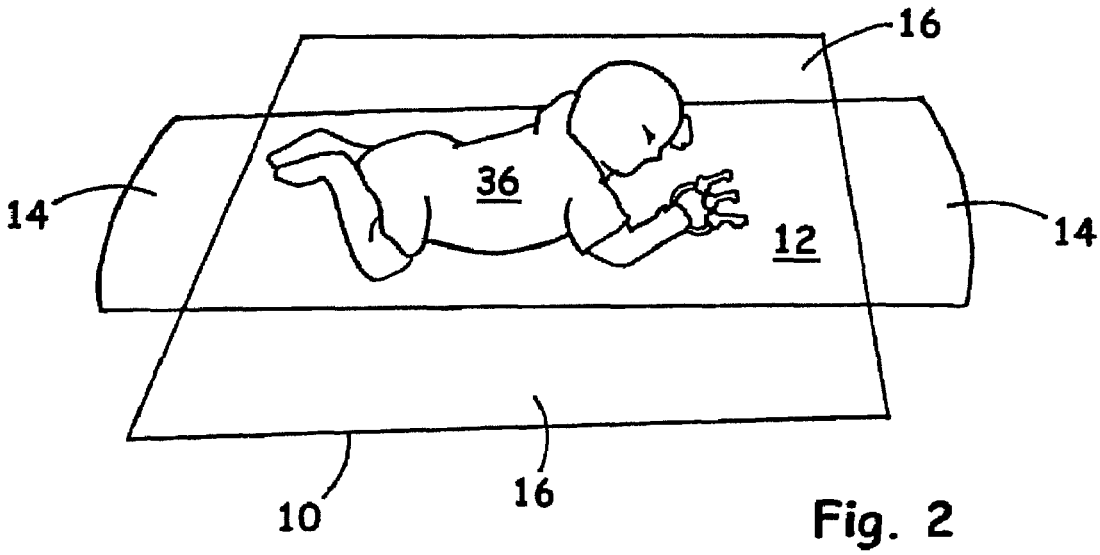
Fig. 2

INFANT PAD ASSEMBLY WITH MULTIPLE CONFIGURATIONS

BACKGROUND OF THE INVENTION

1. Field of the Invention

The present invention relates to a convertible baby or infant bed in combination with a play mat and diaper changing station. More particularly, the present invention is an assembly comprising a rectangular central padded section contiguous with hinged members along each side of the rectangular central section. The hinged members pivot upward and adjoin other proximal hinged members by means of a hook and loop fastener or other means of attachment. The assembly may be folded into a tote form and is provided with a shoulder strap for ease of carrying.

2. Prior Art

There are a number of patents that show or relate to convertible infant changing mats and convertible baby beds. Some of the prior art units are designed as a portable sleeping pad or bed for infants, some have combination uses that include sleeping pads and changing areas, and some are adapted to store and/or carry essential infant-related items. It is believed to be novel to provide a combination of a play mat, portable crib, and diaper changing station with pockets for storage which device is foldable into a compact shoulder-carried assembly. A preliminary patentability search was conducted on this invention and the following listed references were uncovered in the search.

| Pat. No. | Inventor | Date |
|---|---|---|
| Des. 366,368 | McCarthy | Jan. 23, 1996 |
| Des. 467,117 | Guy | Dec. 17, 2002 |
| Des. 503,063 | Bartle, et al. | Mar. 22, 2005 |
| 2,429,350 | Farrand | Oct. 21, 1947 |
| 2,502,486 | Savrin | Apr. 4, 1950 |
| 4,670,923 | Gabriel, et al. | Jun. 9, 1987 |
| 4,698,862 | Mairs | Oct. 13, 1987 |
| 4,712,258 | Eves | Dec. 15, 1987 |
| 4,827,542 | Kurtenback | May 9, 1989 |
| 4,999,863 | Kane | Mar. 19, 1991 |
| 5,115,524 | Antosko | May 26, 1992 |
| 5,165,130 | Wendling | Nov. 24, 1992 |
| 5,473,785 | Lager, et al. | Dec. 12, 1995 |
| 6,408,463 B1 | Palacio | Jun. 25, 2002 |
| 6,574,810 B2 | Mangiaracina | Jun. 10, 2003 |
| 6,920,655 B2 | Mitchell | Jul. 26, 2005 |

The above patents are not considered to be particularly pertinent to the present invention.

Design Pat. 366,368 to McCarthy shows a "Portable Infant Bed and Changing Pad" having a central rectangular pad provided with a flap portion attached to each side thereof, the flap portions meeting at the respective ends thereof to form a raised panel. The means of attaching each end is unclear. The device is provided with a loop-type handle at one end thereof, and is further provided with an attached pad, which pad is provided for the purpose of changing an infant. The inner wall of one panel of the device is provided with what appears to be a small pocket.

Design Pat. 467,117 to Guy shows an "Infant Changing Pad" having a central rectangular pad provided with a flap portion attached to each side thereof. The flap portions may be raised and connected to form a raised panel around the central rectangular portion similar to that shown in McCarthy. The means for attachment is unclear.

Design Pat. 503,067 to Bartle, et al., shows a "Child's Floor Cushion" having a substantially square shape comprising raised outer edges and a depressed central section. The raised outer edges do not appear to be convertible in any manner.

U.S. Pat. No. 2,429,350 to Farrand shows a "Folding Bassinet" comprising a fabric shell having stiffening panels inserted therein to maintain a rigid form. The panels are affixed at their respective ends by string ties to allow for collapsible construction. The stiffening panels may be removed for laundering.

U.S. Pat. No. 2,502,486 to Savrin shows a "Convertible Traveling Case" which includes a collapsible bassinet adapted to fold into a carrying case. However, the carrying case of Savrin is bulky to allow a hollow space on the interior of the case to accommodate items needed for infant care.

U.S. Pat. No. 4,670,923 to Gabriel, et al., shows an inflatable, transparent baby bumper pad for use in a crib, the transparent pad being adapted to allow a parent to view the infant through the baby bumper pad when the pad is in place.

U.S. Pat. No. 4,698,862 to Mairs shows a collapsible portable bassinet that may be adapted to function as an infant carrier or diaper bag by the insertion of various components. The bassinet components may be removed to permit the device to function as a diaper bag.

U.S. Pat. No. 4,999,863 to Kane shows a collapsible baby bed adapted to fold inward on itself to create a carrying case. The Kane device includes a removable central portion or base panel.

The remaining patents disclose various devices having a raised edge or member for confining or supporting an infant. However, none of these patents teaches a combination play mat, portable crib, and diaper changing station with pockets for storage which device is foldable into a compact shoulder-carried assembly.

SUMMARY OF THE INVENTION

A convertible baby or infant travel or "anywhere" bed comprising a rectangular central section which rectangular central section is padded and which rectangular central section has four outer edges. The rectangular central section may comprise a waterproof or water resistant fabric to prevent liquid from penetrating the base of the bed. A washable removable pad insert is adapted to be received within the rectangular central section to provide padding for an infant or toddler, said removable pad insert being approximately 35 inches in length by 18.5 inches in width. The washable removable pad preferably comprises an insert of filler polyurethane foam, lofty polyester batting, or similar filler material and a cover sheet having a top member comprised of an absorbent cotton or similar material and a bottom member comprised of a waterproof material to allow the washable removable pad to be utilized with the cotton side facing upward for napping or when the device is used as a play mat and, alternatively, to permit the waterproof side to face up during diaper changes so the pad can be wiped clean. The cover sheet may be removed from the filler material for ease of laundering.

Each of the four outer edges of the rectangular central section abuts a corresponding proximal hinged member having a length equal to the length of the corresponding edge of the rectangular central section and a height of approximately 9.5 inches, each hinged member being substantially rectangular in shape and having two long ends each having a length of approximately 35 inches and two short ends each having a length of approximately 17.5 inches, the two long ends comprising a top and bottom of the hinged member, the two short ends comprising the sides of the hinged member, the bottom of each of the four hinged members being attached to the rectangular central section such that each hinged member is adapted to pivot upward and adjoin other proximal hinged members at an angle of approximately ninety degrees thereto by means of a hook and loop fastener or other means of attachment affixed to the sides thereof, and alternatively to lie flat against the rectangular central section, for carrying purposes.

Each of the four outer edges is also provided with a removable padding or filler material comprising a polyurethane foam, batting material, or similar filler which may be removed from each of the respective outer edges to permit laundering of the cover material if desired. The two long ends are provided, at the respective short edges thereof, with a tab to which one half of a hook and loop fastener is affixed. The two short ends are provided, at the respective short edges thereof, with a second half of a hook and loop fastener affixed thereon. When the proximal hinged members are pivoted upward to form the 90_ angle, the closure tabs may be folded over the short edge of each short end allowing the first and second hook and loop fasteners to contact each other and secure the respective edges together. The two short ends of the hinged end members are further provided, on one side thereof, respectively, with a stabilizing tab comprising one half of a hook and loop fastener having a first and second end, the first end of the stabilizing tab being connected to the short end of the hinged end member, the second end of the hook and loop fastener stabilizing tab being adapted to be received on a receiver strip, which receiver strip is attached to an inner edge of one of the hinged side members, the hinged side member having a receiver strip on both short ends thereof, the receiver strip being adapted to lie in a parallel relation to the short end of the hinged side member. When the device of the present invention is employed in the diaper changing station embodiment, the stabilizing tab is pulled downward by a user and placed in contact with the receiver strip to secure the upright panels comprising the opposite hinged side member and the two hinged end members.

The top portion of the hinged members may be straight so as to form a rectangular hinged member or, alternatively, may be rounded to provide greater height at the respective ends to allow pockets to be attached thereon. The rounded top portion provides increased stability of the hinged members and allows for deeper pockets to be affixed to either or both ends and prevents said pockets from sagging when heavier items are placed in the pocket. Each hinged member is provided, at its respective corners or short ends, with a hook and loop or similar type fastener to permit the four outer members to attach to one another in sequence when placed in perpendicular relation to the rectangular central section. In this embodiment, the four hinged members form a crib-type barrier to prevent an infant or baby, when the infant or baby is received on the rectangular central section, from rolling away from the rectangular central section. The hinged members may be laid out flat (in an unassembled position) to provide a flat play mat for an infant or baby.

Alternatively, one hinged member corresponding proximally to a longer edge of the rectangular central section may be laid out flat with the remaining hinged members joined to provide a diaper-changing surface. The rectangular central section may be provided with a foam cushion or filler material that is removable for washing purposes and may comprise a waterproof outer member to prevent liquids from penetrating the outer surface of the rectangular central section. The four hinged members may be provided with filler material or, alternatively, left substantially flat.

One or more of the hinged members may also be provided with a "net" type pocket, fabric pocket, or other type pocket along the outer (distal) surface thereof for storing extra diapers, a book, or similar object. The entire assembly may be folded into a pillow-sized handbag for portability and is provided with a shoulder-type carrying strap by detaching the hinged members from adjacent hinged members by releasing the hook and loop fasteners, folding the hook and loop closure tabs flat against the inside portion of the long hinged member, folding each of the long hinged members toward the rectangular central section, and beginning at the end of the device that is not provided with hook and loop fastening straps, folding the length of the device three times and securing the folded device with hook and loop fastening straps. The convertible baby or infant travel or "anywhere" bed may also be adapted for use as a pet bed in the same manner described herein, substituting a dog, cat, or other household pet for an infant.

BRIEF DESCRIPTION OF THE DRAWINGS

FIG. 1 is a bottom view of the convertible infant pad assembly of the present invention in an unfolded or flat position.

FIG. 2 is a perspective view of the convertible infant pad assembly of the present invention in an unfolded or flat "play mat" position with an infant received on the central rectangular member.

DETAILED DESCRIPTION OF THE PREFERRED EMBODIMENTS

Figure 5:
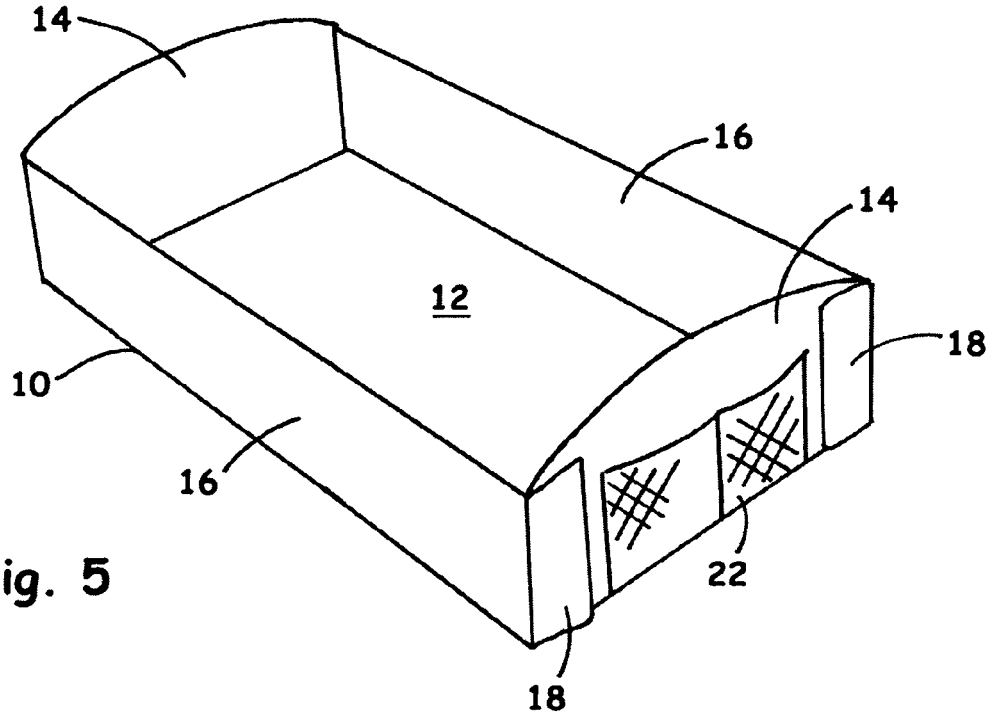
FIG. 5 is a perspective view of the convertible infant pad assembly of the present invention showing all four hinged members connected at the respective sides thereof to create a portable or "anywhere" bed for an infant.
Figure 6:
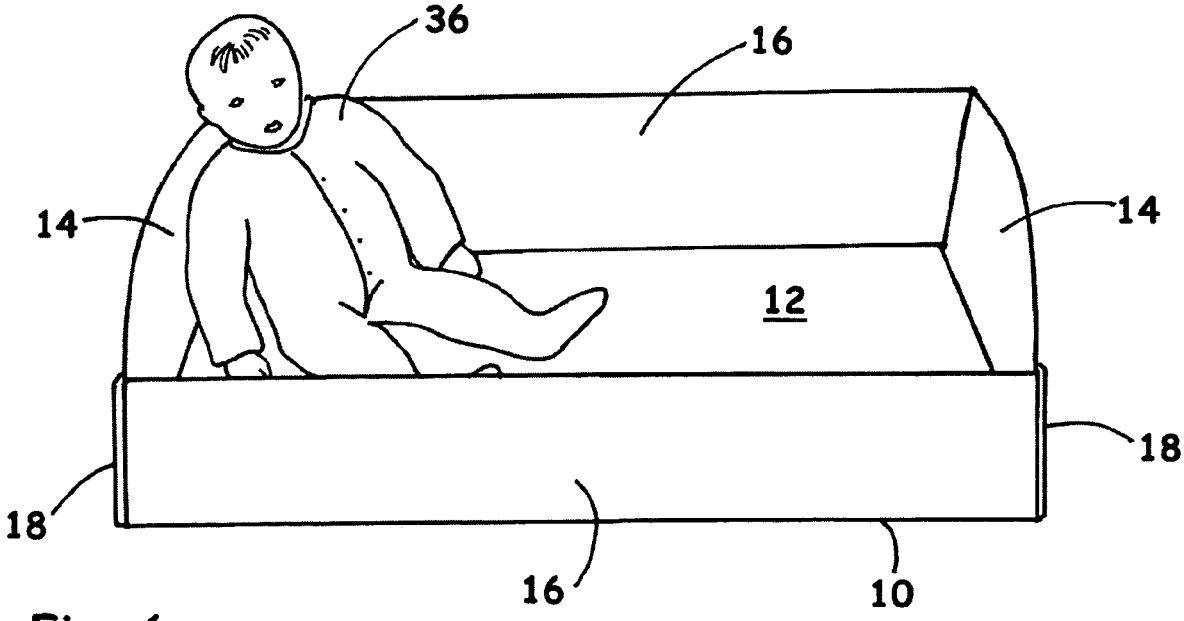
FIG. 6 is a perspective view of the convertible infant pad assembly of the present invention showing the embodiment of FIG. 5 with an infant received on the central rectangular member.

FIG. 1 shows the bottom or base of the convertible infant pad assembly 10 of the present invention in an unfolded or flat position comprising a rectangular central section 12 having a top portion (not shown in this Figure) and a bottom portion, the top portion of the rectangular central section 12 preferably comprising a waterproof fabric, the bottom portion of the rectangular central section 12 being provided with two hook and loop fastening straps 34 which are set in approximately one inch (1") from the side seam along the outer edges thereof and which are affixed at one end thereof to the bottom portion of the rectangular central section 12, and the bottom portion of the rectangular central section 12 being further provided with a shoulder strap 32 affixed below the two hook and loop fastening straps 34. The rectangular central section 12 may be padded or, in the alternative, a washable removable pad insert (not shown) may be adapted to be received within the rectangular central section 12, the washable removable pad insert having a cover sheet including a top side comprising a cotton-type fabric for absorbency and a bottom side comprising a waterproof fabric and a removable filler material to allow the cover sheet to be removed from the filler material for ease of laundering. Along the perimeter of the rectangular central section 12 are four corresponding proximal hinged members comprising two hinged end members 14 and two hinged side members 16, each of the hinged members having a length equal to the length of the corresponding edge of the rectangular central section. The hinged side members 14 are provided with closure tabs 18 on their respective short edges (not numbered), which closure tabs 18 are provided with one half of a hook and loop or similar type fastener thereon; the hinged end members 16 are provided with one half of a hook and loop or similar type fastener 20 affixed along their respective short edges which is adapted to correspond with the hook and loop type fastener affixed to the closure tabs 18 to secure the respective short edges of the hinged side members 16 to the hinged end members 14 at an angle of approximately ninety degrees (90_) (as best shown in FIGS. 5 and 6).

FIG. 2 shows the convertible infant pad assembly 10 of the present invention in an unassembled or flat embodiment for use as a play mat. In this embodiment, the hinged end members 14 are disconnected from the hinged side members 16 by releasing one half of the hook and loop fasteners 20 from the corresponding hook and loop fastener affixed to the stabilizing tab 18 and allowing the hinged end members 14 and hinged side members 16 to lie flat with respect to the rectangular central section 12. An infant 36 or toddler (not shown) may be placed on the rectangular central section 12. In this embodiment, the washable removable pad insert (not shown) would optimally be positioned in the rectangular central section 12 with the fabric or absorbent side facing upward so as to provide a soft play surface for the infant 36 or toddler.

Figure 3:
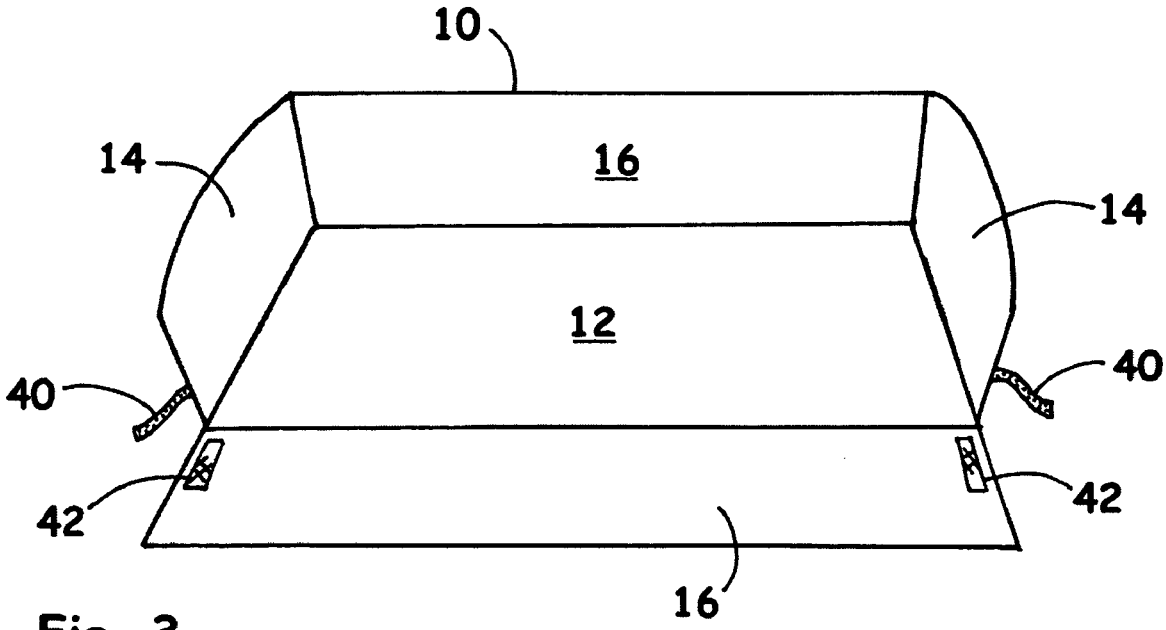
FIG. 3 is a perspective view of the convertible infant pad assembly of the present invention showing three hinged members connected at the respective sides thereof to create a "diaper changing station."

FIG. 3 shows the convertible infant pad assembly 10 of the present invention in a partially assembled embodiment for use as a diaper changing station. In this embodiment, the hinged end members 14 are connected at one end thereof to a single hinged side member 16, allowing the opposite hinged side member 16 to lie flat with relation to the rectangular central section 12 to permit a user (not shown) easy access to an infant (not shown in this Figure) for the purpose of changing a soiled diaper or clothing. In order to provide greater stability for the convertible infant pad assembly 10 in this position, a stability tab 40 is provided along the short edge of the hinged end members 14. A corresponding receiver strip 42 is attached to the inner portion of the hinged side member 16 at either end thereof in parallel relation to the short edges of the hinged side member 16. In this embodiment, the washable removable pad insert (not shown) would optimally be positioned in the rectangular central section 12 with the waterproof side facing upward so as to provide a non-absorbent surface which may be wiped clean in the event that it becomes soiled.

Figure 4:
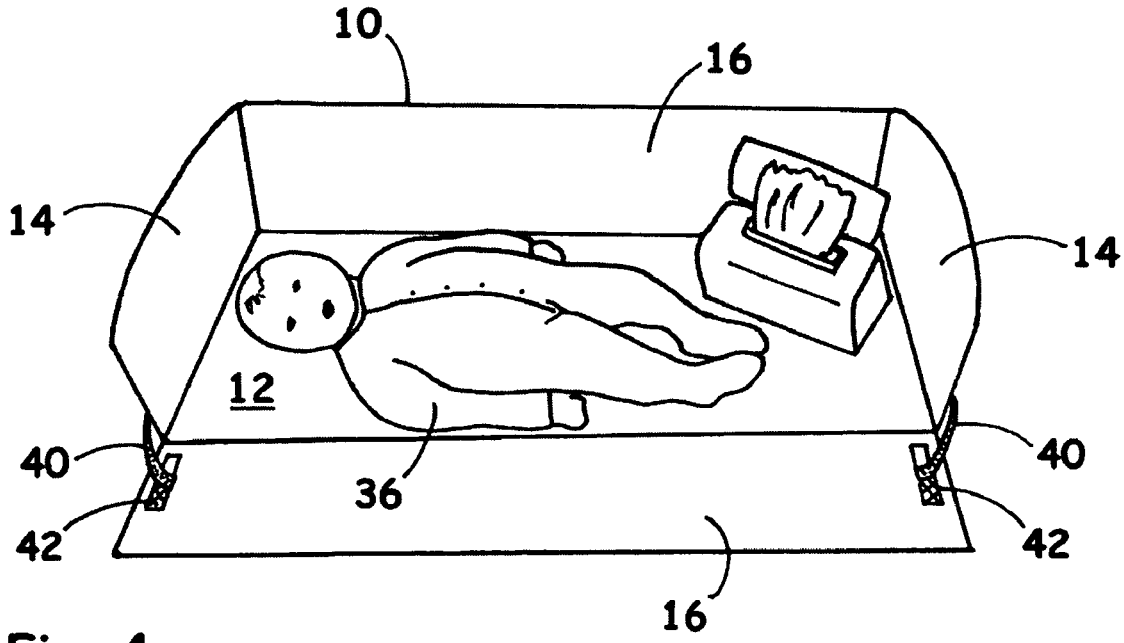
FIG. 4 is a perspective view of the convertible infant pad assembly of the present invention showing the embodiment of FIG. 3 with an infant received on the central rectangular member.

FIG. 4 shows the convertible infant pad assembly 10 of the present invention in a partially assembled embodiment for use as a diaper changing station similar to that shown in FIG. 3, but with an infant 36 positioned on the rectangular central section 12. By lowering one hinged side member 16, a user (not shown) can easily access the infant 36 for the purpose of changing a diaper or clothing or similar. A stability tab 40 as discussed in FIG. 3 is provided along the short edge of the hinged end members 14. A corresponding receiver strip 42 is attached to the inner portion of the hinged side member 16 at either end thereof in parallel relation to the short edges of the hinged side member 16. In this Figure, the stability tab 40 is pulled by a user (not shown in this Figure) in a downward motion toward the corresponding receiver strip 42 and brought into contact with the receiver strip 42 to secure the upright members comprising the opposite hinged side member 16 and the two hinged end members 14 in position in the event that the infant 36 rolls into, kicks, or otherwise contacts the upright members.

FIG. 5 shows the convertible infant pad assembly 10 of the present invention in a fully assembled embodiment for use as an infant napper or portable bed. In this embodiment, the hinged end members 14 are connected at both ends thereof to the respective hinged side members 16 by pivoting the hinged members 14 and 16 upward to form a 90_ angle and folding the closure tabs 18 affixed to the short ends of the hinged side members 16 over the short edge of each short end allowing the first half of the hook and loop fastener (affixed to the closure tabs 18) and second hook and loop fasteners 20 (not visible in this Figure) to contact each other and secure the respective edges together. A net or mesh pocket 22 is affixed to one hinged end member 14 to facilitate storage of items such as a baby bottle, diapers, or the like, FIG. 6 shows the convertible infant pad assembly 10 of the present invention in a fully assembled embodiment for use as an infant napper or portable bed similar to that shown in FIG. 5 with an infant 36 positioned on the rectangular central section 12. In this embodiment, the infant 36 or toddler may sit or recline in the rectangular central section 12. If the infant 36 or toddler rolls during sleep, the hinged end members 14 and hinged side members 16 would prevent the infant 36 from rolling away from the rectangular central section 12. In this embodiment, the washable removable pad insert (not shown) would optimally be positioned in the rectangular central section 12 with the fabric or absorbent side facing upward so as to provide a soft sleep surface for the infant 36 or toddler.

Figure 7:
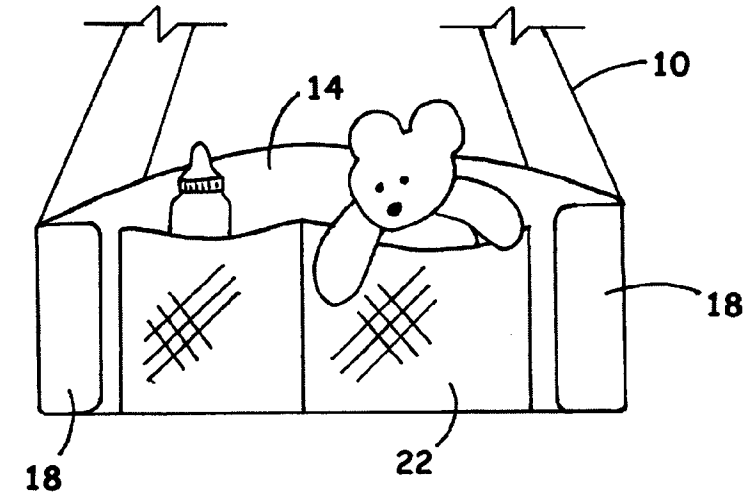
FIG. 7 is a side view of the convertible infant pad assembly of the present invention showing a rectangular embodiment of the hinged member in combination with a fabric storage pocket affixed thereto.

FIG. 7 shows a first hinged end member 14 of the convertible infant pad assembly 10 of the present invention which hinged end member 14 is provided with a net or mesh pocket 22 affixed thereon to provide convenient open storage for items such as a baby bottle (not numbered), toys (not numbered), or other items.

Figure 8:
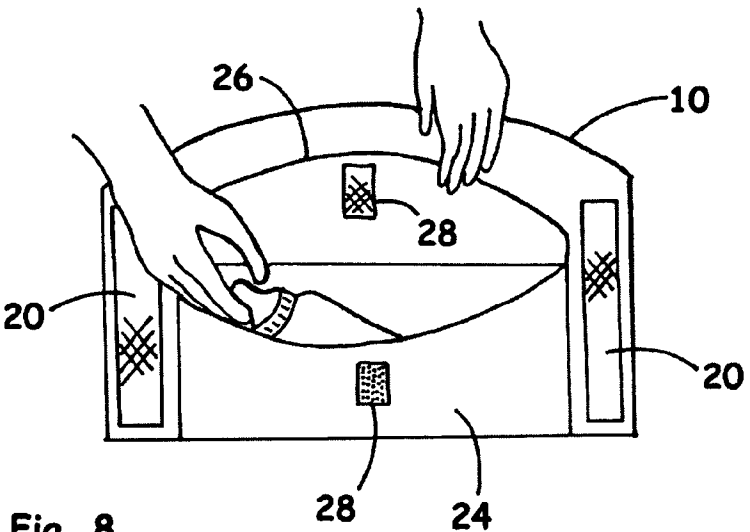
FIG. 8 is an end view of the convertible infant pad assembly of the present invention showing a curved-top embodiment of the hinged member in combination with a mesh storage pocket affixed thereto.

FIG. 8 shows a second hinged end member 14 of the convertible infant pad assembly 10 of the present invention which hinged end member 14 is provided with a fabric pocket 24 affixed thereon to provide convenient closed storage for items such as a baby bottle (not numbered), diapers (not shown), or other items.

Figure 9:
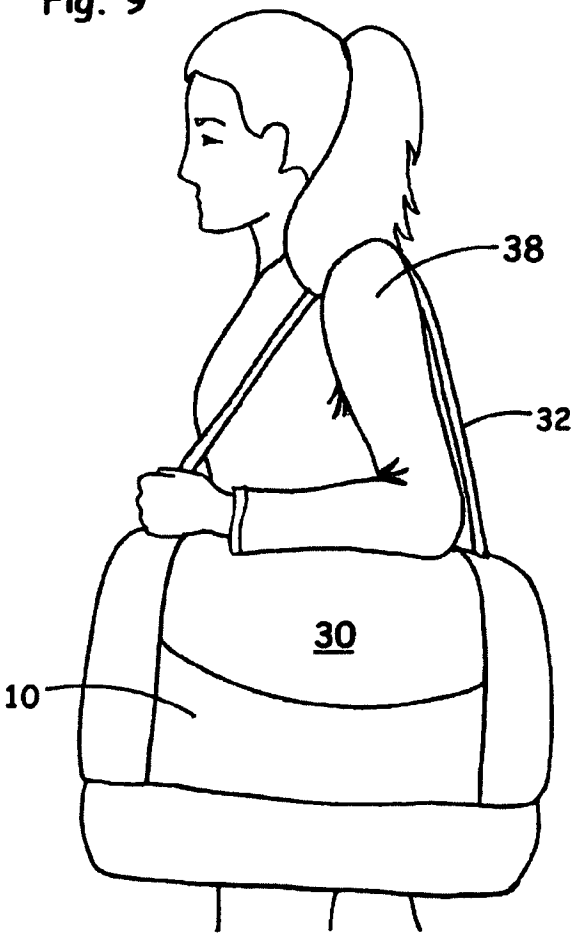
FIG. 9 is a perspective view of the convertible infant pad assembly of the present invention showing the assembly folded into a carrying case and worn on the shoulder of an adult female.

FIG. 9 shows the convertible infant pad assembly 10 of the present invention folded into a rolled assembly 30 and secured with the hook and loop fastening straps 34 (not shown in this Figure) carried by a user 38 by means of the shoulder strap 32 which is adapted to be received over the shoulder of the user 38 for ease of transporting the convertible infant pad assembly 10 while leaving the user's 38 arms free to carry an infant (not shown in this Figure), push a stroller, or engage in other activity. While FIGS. 1 through 9, inclusive, depict the various positions which may be achieved with the convertible infant pad assembly 10 of the present invention, it should be apparent that other and further modifications of the present invention, apart from those shown or suggested herein, may be made within the spirit and scope of this invention, including (but not limited to) increasing the measurements cited herein to accommodate a daycare-sized cot or decreasing the measurements cited herein to accommodate a premature or small infant, altering the fabric selections, or eliminating the waterproof members. In addition, the convertible infant pad assembly 10 of the present invention may be used in conjunction with a small animal, such as a dog or cat, as a convertible pet bed assembly by substituting a pet for the infant described herein.

What is claimed is:

1. An infant pad assembly comprising:

a flat central section having a top and a bottom and at least four straight sides;

a flat side section for each of the at least four straight sides of the central section, each side section having a inner edge, first and second end ends each with first and second end edges and a top edge, each inner edge being hingedly attached to the side of the central section for pivotal movement relative thereto;

wherein, when all the side sections are positioned in a flat position co-planar with the central section, the infant pad assembly forms an infant play mat;

wherein the central section and the flat side sections are configured so that, when all the side section are pivoted toward the top of the central section to an upright position perpendicular to the central section, each side section is between two other side sections and immediately adjacent thereto so that each pair of adjacent side sections forms a corner and so that the side sections collectively form a substantially complete side wall around the central section comprising a portable infant bed;

a corner connector for removably attaching adjacent side sections to each other;

wherein at least one of the side sections includes a receiver on each of its first and second ends and wherein the end of each side section adjacent to the at least one side section includes a stability tab connectable to the receiver on the adjacent end of the at least one side section, so that when the corner connector is disconnected and each of the stability tabs is connected to the corresponding receiver, the at least one side section is prevented from pivoting past the flat position toward the bottom of the central section, and so that when the at least one side section is thereby secured in the flat position and the remaining side sections are all in the upright position, the infant pad assembly forms a changing mat; and wherein the central section and all the side sections are flexible panels so that when all the corner connectors and stability tabs are disconnected, the side sections can be pivoted all the way toward the top of the central section into a collapsed position and so that the infant pad assembly in the collapsed positioned can be rolled into a carrying case; and a shoulder strap on the bottom of the central section for carrying the infant pad assembly in the carrying case mode.

2. The infant pad assembly of claim 1 wherein the at least four sides of the central section is only four sides.

3. The infant pad assembly of claim 2 wherein the central section is rectangular.

4. The infant pad assembly of claim 3 wherein each corner connector comprises a tab extending from the end edge of the end of one of the adjacent side panels, a first strip of hook and loop fastener fixed to the tab, and a second strip of hook and loop fastener on the end of the other of the adjacent side panels, the second strip engageable with the first strip.

5. The infant pad assembly of claim 4 wherein the first and second strips of hook and loop fastener extend along substantially the entire end of the adjacent side panels.

6. The infant pad assembly of claim 1 wherein the receiver comprises a strip of hook and loop fastener and wherein the stability tab comprises a cooperating piece of hook of look fastener.

7. The infant pad assembly of claim 1 wherein the infant pad assembly comprises at least one pocket.

8. The infant pad assembly of claim 7 wherein the infant pad assembly comprises two pockets including a first pocket on one of the at least four side panels and a second pocket on another of the at least four side panels.

9. The infant pad assembly of claim 8 wherein the first pocket is formed by a net panel.

10. The infant pad assembly of claim 9 wherein the second pocket is a fabric enclosure.

* * * * *